United States Patent [19]

Stich et al.

[11] 4,404,442

[45] Sep. 13, 1983

[54] CIRCUIT INTERRUPTER HAVING FLASH PLATES WITH INTERRUPTED SURFACES

[75] Inventors: Frederick A. Stich, Milwaukee, Wis.; John D. Kleinecke, Wichita Falls, Tex.; Roger L. Robertson, Slidell, La.

[73] Assignee: Siemens-Allis, Inc., Atlanta, Ga.

[21] Appl. No.: 220,374

[22] Filed: Dec. 29, 1980

[51] Int. Cl.[3] ..... H01H 33/02

[52] U.S. Cl. ..... 200/144 R; 200/147 R

[58] Field of Search ..... 200/147, 144

[56] References Cited

U.S. PATENT DOCUMENTS 2,648,744 8/1953 Strom et al. ..... 200/147 R 2,933,574 4/1960 Frink ..... 200/147 R 3,511,950 5/1970 Boyd ..... 200/147 R

*Primary Examiner*—Robert S. Macon

*Attorney, Agent, or Firm*—Frederick W. Powers, III

[57] ABSTRACT

A circuit interrupter of the type including an arc chute and separable contacts between which an arc may be drawn is provided with flash plates. The plates are disposed at either side of the region in which an arc forms and serve to protect the adjacent interrupter housing, while assisting in channeling the arc into the arc chute. The flash plates are formed of a ceramic material and are provided with a plurality of grooves running the direction generally transverse to the direction of the arc.

1 Claim, 3 Drawing Figures

CIRCUIT INTERRUPTER HAVING FLASH PLATES WITH INTERRUPTED SURFACES

BACKGROUND OF THE INVENTION

The present invention relates to circuit interrupters, and more particularly to arc control and protection means therefor.

Circuit interrupters such as contactors and circuit breakers which are designed to interrupt relatively high electric currents frequently encounter an electric arc between the separating contacts. In order to confine and extinguish the arc it is conventional to provide upwardly-extending conductive members, known as arc runners or arc horns, along with means such as an electromagnetic blowout coil for driving the arc along the arc runners in a direction away from the contacts and switching mechanism. The area in which the arc is confined is termed an arc chute. It is conventional to provide the arc chute with a number of transverse baffle plates or barriers which form an ever-narrowing aperture into which the arc is drawn, cooled, and ultimately extinguished. Ordinarily the arc chute and barriers extend beyond the arc extinguishing region so as to further cool and deionize the air or other dielectric gas sufficiently to prevent residue from the arc from causing a flashover at the outermost end of the arc chute.

An illustration of such a design is disclosed in U.S. Pat. No. 3,202,790—Burton. In the Burton patent, as in most interrupters of this type, a pair of inclined ramp-like surfaces termed "flash plates" are provided at the lowermost or entry end of the arc chute.

Until recently arc chutes, barriers and flash plates were typically formed of asbestos and in many cases were 1- or 2-piece molded structures. However, owing to health and safety considerations the use of asbestos materials for this purpose has been severely attenuated. It has been found preferable to supplant asbestos materials in structures of this type with other insulative, heat-resistant materials such as polyesters, glass-filled products, ceramics and other refractory materials. Unfortunately, such materials frequently do not have the same heat-resisting qualities as asbestos, and frequently are more expensive. Further, it has been found that non-asbestos structures, when formed in the conventional configurations, do not perform as well as their asbestos predecessors as they are prone to accumulate conductive arc products along their surfaces. Hence many manufacturers require that their non-asbestos circuit interrupter structures be cleaned after a specified number of interruptions in order to assure proper operation and prevent the occurrence of secondary or "restrike" arcs.

It is therefore an object of the present invention to provide an improved circuit interrupting structure which is less likely to allow "restrike" arcs to occur.

Another object of the present invention is to provide a circuit interrupter having refractory non-asbestos flash plates which resist deterioration due to arc product buildup.

SUMMARY OF THE INVENTION

Briefly stated, in accordance with one aspect of the invention the foregoing objects are achieved by disposing a pair of non-asbestos refractory flash plates upon opposite sides of the contact means, generally adjacent the entry end of an arc chute. Preferably the confronting surfaces of the flash plates are inclined toward one another so that the edges closest to the arc chute are closer to one another than the edges which are remote from the arc chute. A series of grooves are provided for interrupting the confronting surfaces of each flash plate, extending generally transversely to the path of the arc drawn between the contact means. The grooves have a sufficient depth-to-width ratio to prevent conductive arcing products from accumulating within them.

BRIEF DESCRIPTION OF THE DRAWINGS

While the specification concludes with claims particularly pointing out and distinctly claiming the subject matter which is regarded as the invention, it is believed that the invention will be better understood from the following description of a preferred embodiment taken in conjunction with the accompanying drawings in which:

DESCRIPTION OF A PREFERRED EMBODIMENT

Figure 1:
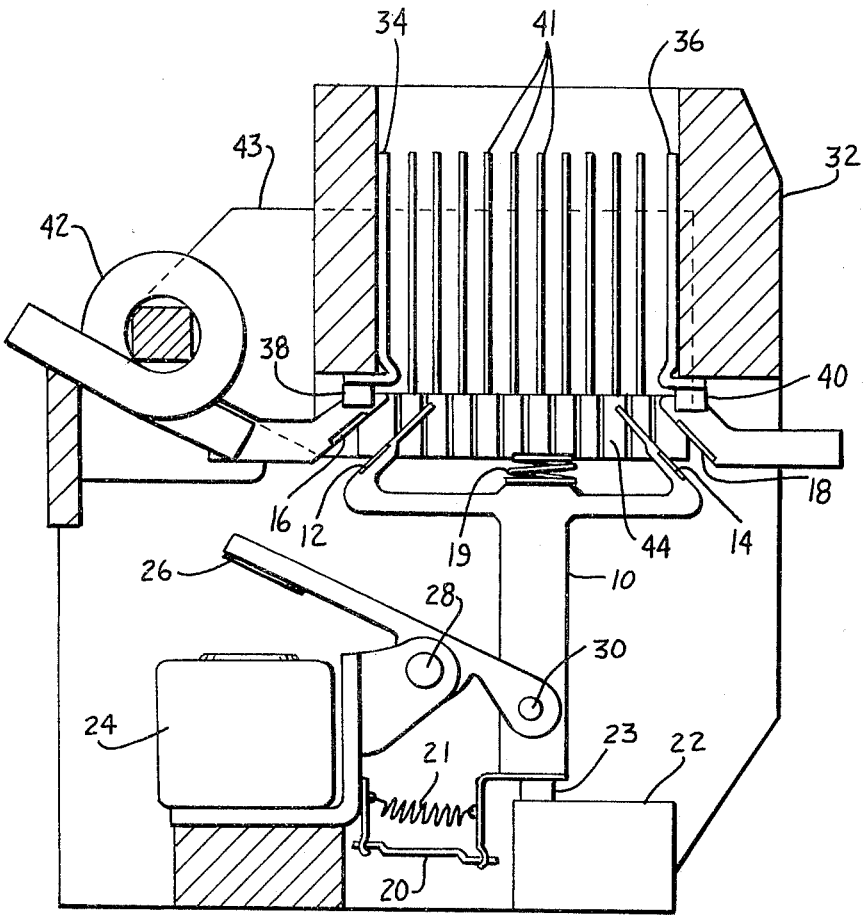
FIG. 1 is a sectional elevational view of a circuit interrupter incorporating the present invention.

FIG. 1 illustrates a form of circuit interrupter known as a contactor, which is adapted to open and close the circuit of an electrical load such as a motor or the like. It will be appreciated that many types of circuit breakers contain structural features much like that in the depicted contactor, and it should be understood that the present invention is equally applicable to all such forms of circuit interrupting mechanisms.

While the present invention is equally applicable to contactors having a single movable contact the contactor illustrated is of the two-contact type, including a movable contact assembly 10 bearing first and second movable contacts 12 and 14. The latter engage first and second stationary contacts 16 and 18, respectively, so that a circuit is interrupted simultaneously at two points.

The movable contact assembly is biased downwardly by a spring 19 and is constrained to move vertically by appropriate means such as a parallellogram link 20 and keeper spring 21. A fixed stop 22 receives the lower portion 23 of the moving assembly and defines the lowermost point of its travel. An electromagnetic operator 24 reciprocates the movable contactor assembly by means of an armature 26 which is journaled both upon the operator, by means of a pin 28, and upon the movable contact assembly by means of another pin 30.

In order to receive and extinguish the arcs which occur upon the opening of a circuit, an arc chute structure is provided. The structure includes an outer housing 32, which may be an integral part of the overall enclosure of the contactor. A pair of arc runners 34 and 36 extend upwardly at opposite sides of the arc chute, and the lower ends of the arc runners are electrically coupled to the stationary contacts 16, 18 by means of clips 38 and 40, respectively. In this manner electrical continuity is provided between the runners and the stationary contacts, so that the contacts are effectively extended upwardly at opposite sides of the arc chute.

As is conventional in such structures, the arc chute encloses a number of barrier plates generally indicated at 41. The lowermost edges of the plates are provided with deep notches to facilitate the extinguishment of an arc which is moved upwardly through the arc chute. A blowout coil 42 produces an electromagnetic field which is transferred to the barrier region in a conventional manner by means of pole pieces 43. Supporting the lowermost edges of the barriers is a flash plate 44. It will be appreciated that a corresponding flash plate is disposed at the opposite side of the contact means and extends parallel to plate 44. The second flash plate, however, is not visible owing to the fact that the Figure has been sectioned.

Figure 2:
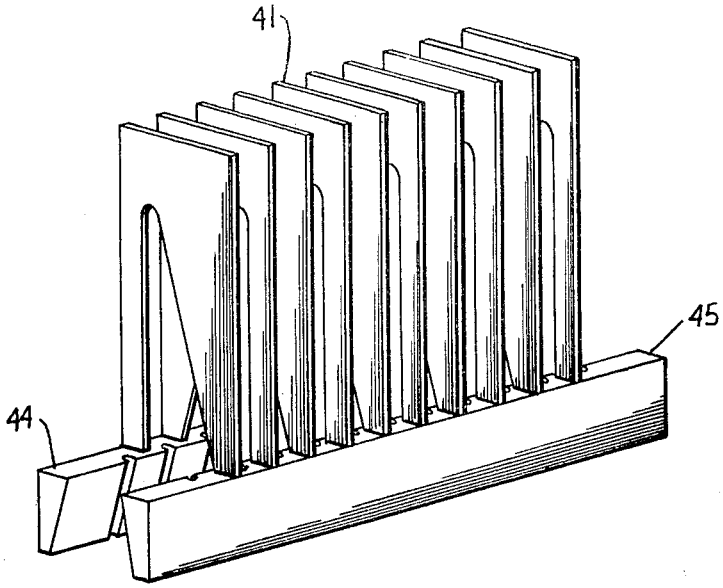
FIG. 2 illustrates the relationship between elements of the apparatus of FIG. 1.

Referring now to FIG. 2, the relationship of barriers 41 and flash plates 44 and 45 is seen. The alternation of the V-shaped slots in the barriers is also visible. When separate barriers are utilized as an alternative to the one-piece molded construction as illustrated in U.S. Pat. No. 3,202,790, the upper edges of the flash plates provide a convenient supporting surface for the lower ends of the barriers. Further, it will be noted that the confronting surfaces of the flash plates are inclined in such a manner that the uppermost edges of the flash plates are closer than the lower edges thereof. This configuration forms a ramp or throat which encourages the movement of the arc upwardly into the arc chute.

In operation the contactor is closed by energizing operator 24, thus creating a magnetic field which pulls the free end of armature 26 downwardly, causing the armature to pivot about pin 28 and urging the movable contact assembly upward against the pressure of spring 19 until movable contacts 12 and 14 firmly engage fixed contacts 16 and 18, respectively. In this manner, current is allowed to flow unimpeded through the contactor.

When it is necessary to interrupt the circuit, operator 24 is deenergized. The previously-compressed spring 19 forces the movable contact assembly downwardly, separating the movable contacts from the fixed contacts. Depending upon circuit characteristics, voltage, and current flow, as the contacts begin to separate an arc may extend between the fixed contacts. Owing to the continuing flow of current through blowout coil 42, and the resulting magnetic field which extends across the path of the arc, the arc is propelled upwardly into the arc chute. Upward movement of the arc is facilitated by arc runners 34 and 36, the ends of the arc being immediately transferred from the fixed contacts to the nearby arc runners and progressing up the runners. The arc moves upwardly into the arc chute, and thus into the V-shaped notches of the barrier plates. Owing to the narrowing nature of the slots in the barrier plates and the staggered orientation of the plates, the path of the arc becomes progressively longer until it is eventually cooled and extinguished.

The foregoing description is typical of the operation of circuit interrupters utilizing arc chutes. It will be readily understood that the arc releases a great deal of energy in the form of heat and produces arc products including materials from contact ablation, ionization products, and occasionally incinerated impurities. Due to the heating of the arc chute barriers the extinguishing ability of the arc chute is temporarily, but severely, diminished. Thus, if a restrike of the arc occurs the arc chute may be incapable of extinguishing the resulting, second arc.

It will be appreciated that immediately upon the extinction of the initial arc there is a transient voltage surge which occurs between the fixed contacts 16 and 18. If there is insufficient dielectric strength of the path between the contacts, the high transient voltage may cause a second arc, known as a restrike, to occur. Ordinarily, circuit interrupters are designed to preclude restrikes from occurring when properly maintained. With previous designs, flash plates were formed of molded asbestos, and owing to the physical qualities of the molded asbestos and the ablation which occurs, conductive arc products were not accumulated upon their surfaces. Hence, in a properly-designed circuit interrupter a restrike was unlikely to occur. However, upon the substitution of otherwise-suitable refractory materials for asbestos, it was discovered that arcing products did accumulate upon the surfaces with the result that restriking occurred. It is believed that the restriking phenomenon arises because the substituted flash plate material, unlike asbestos, accumulated sufficient arcing products thereon to form a path of insufficiently high resistance between the fixed contacts which would support a restrike arc.

The present inventors have found that the propensity for the non-asbestos flash plates to accumulate arc products can be counteracted by the provision of multiple interruptions, most easily characterized as grooves, in the faces of the flash plates. In FIGS. 1 and 2 it will be seen that flash plate 44 is provided with a series of grooves which are generally aligned with the spaces between barriers 41. Further, the grooves extend transversely with respect to the path of the arc, generally considered to be a line extending between the fixed contacts 16 and 18.

Figure 3:
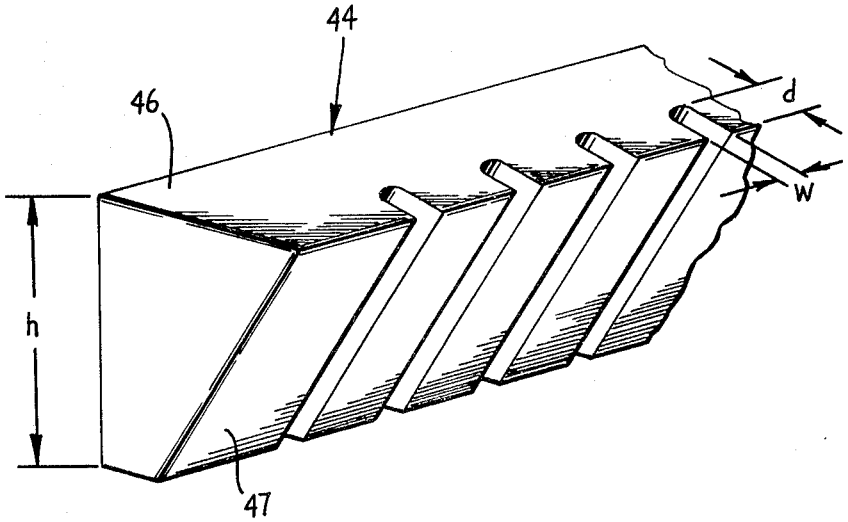
FIG. 3 is a detailed view of a flash plate of FIG. 2.

FIG. 3 illustrates the preferred formation of a flash plate in accordance with the present invention. Upper surface 46 forms a convenient support for the barrier plates. The grooves, placed in inclined face 47 which confronts the corresponding face of the opposed flash plate, are spaced so as to correspond with the gaps between successive barrier plates and are sufficiently deep so that the inner surfaces are shielded from the arc products.

In a successfully tested embodiment, flash plates were made of mullite. Mullite molded in the form desired may be obtained from numerous sources, one of which is Hamilton Porcelains of Hamilton, Ontario, Canada. This manufacturer utilizes the designation R-15 for the mullite utilized by the inventors. However, it is contemplated that other, equivalent refractory materials which have the requisite dielectric strength and heat resistance may be selected for use.

Although the phenomena which are involved are not completely understood, it is believed that in the presence of an electric arc molded asbestos materials ablate or evaporate, which serves to prevent or to minimize the deposition of metallic deposits or carbonaceous arc products upon the asbestos surface. When refractory materials such as ceramics are substituted, this effect no longer occurs and arc products are deposited upon the faces of the flash plates. The inventors have found that providing the flash plates with grooves sufficiently deep so that the arc products are not deposited therein the detrimental effect of the arc product buildup may be overcome. In this manner the otherwise-conducting surface formed by the deposit of arc products is interrupted, and restriking is effectively prevented.

There is no known dimension or relationship which can be ascribed to the grooves for preventing an arc product build up therein. Numerous variables affect the arc product buildup so that the optimum or minimum groove depth must be established empirically. However, in a succesfully-tested embodiment grooves 0.12 inches (0.3 cm) in depth d and 0.09 inches (0.2 cm) in width w were found to work satisfactorily. The grooves were spaced apart by 0.19 inches (0.48 cm), and the flash plate had a height h of approximately 1 inch (2.5 cm).

In laboratory tests, it was found that one arc interruption of a sample contactor at its full 50 MVA rating would sufficiently contaminate non-grooved, ceramic flash plates to such an extent that a near failure (restrike) occurred upon the next interruption and total failure and destruction of the apparatus occurred upon the third attempted interruption. The flash plates could be restored after each interruption by sandblasting or otherwise removing the arc accumulated products; however, this necessitated diassembly of the contactors, and is undesirable in practice. After substituting grooved flash plates of the type depicted in the Figures, the identical test apparatus was operated five consecutive times without failure or restrike.

Upon gaining an understanding of the disclosed invention it will be apparent to those skilled in the art that different groove configurations or, equivalently, sets of upstanding ribs, may be provided upon refractory flash plates in order to gain the same result achieved with the depicted embodiment. What is believed fundamental to the practice of the invention is the provision of multiple interruptions in the faces of the flash plates which form zones that are are shielded from the arc product stream. The shielding is provided by the depth, or more precisely the ratio of depth-to-width, of the interruptions in the faces of the flash plates.

As will be evident from the foregoing description, certain aspects of the invention are not limited to the particular details of the examples illustrated, and it is therefore contemplated that other modifications or applications will occur to those skilled in the art. It is accordingly intended that the appended claims shall cover all such modifications and applications as do not depart from the true spirit and scope of the invention.

What is claimed as new and desired to be secured by Letters Patent of the United States is:

1. In a circuit interrupter having separable contact means for breaking a circuit, operator means for causing said contact means to separate, an arc chute adjacent said contact means and enclosing a plurality of substantially parallel, insulative barrier plates having notches at the ends thereof adjacent said contact means, and a pair of substantially parallel flash plates disposed upon opposite sides of said contact means, the confronting surfaces of said flash plates being inclined so that the edges of said flash plates closest to said barrier plates are closer together than the edges of the flash plates remote from said barrier plates, said confronting surfaces of said flash plates being interrupted by a plurality of grooves extending in a direction generally perpendicular to a line extending between said contact means, the ratio of depth to width of said grooves being sufficient to prevent the accumulation of deposits resulting from the occurrence of arcs between said flash plates.

* * * * *